United States Patent [19]

Sarcia

[11] 4,438,631

[45] Mar. 27, 1984

[54] CRYOGENIC REFRIGERATOR

[75] Inventor: Domenico S. Sarcia, Carlisle, Mass.

[73] Assignee: CVI Incorporated, Columbus, Ohio

[21] Appl. No.: 398,482

[22] Filed: Jul. 15, 1982

[51] Int. Cl.[3] ..... F25B 9/00

[52] U.S. Cl. ..... 62/6; 60/520

[58] Field of Search ..... 62/6; 60/517, 518, 519, 60/520

[56] References Cited

U.S. PATENT DOCUMENTS

| | | | |
|---|---|---|---|
| 3,625,015 | 12/1971 | Chellis | 62/6 |
| 3,812,682 | 5/1974 | Johnson | 62/6 |
| 4,092,829 | 6/1978 | Durenec | 62/6 |
| 4,180,984 | 1/1980 | Chellis | 62/6 |
| 4,333,755 | 6/1982 | Sarcia | 62/6 |

*Primary Examiner*—Ronald C. Capossela

*Attorney, Agent, or Firm*—Seidel, Gonda & Goldhammer

[57] ABSTRACT

The cryogenic refrigerator includes a movable displacer within an enclosure having first and second chambers of variable volume. A refrigerant fluid is circulated in a fluid path between said chambers and correlated with movement of the displacer. A spool valve controls introduction of high pressure fluid and low pressure fluid to said chambers. The displacer movement is controlled by an electric motor which has a cam for reciprocating the spool valve member.

11 Claims, 4 Drawing Figures

CRYOGENIC REFRIGERATOR

RELATED CASE

See my pending application Ser. No. 369,864 filed Apr. 19, 1982 and entitled Cryogenic Refrigerator. The disclosure therein is incorporated herein by reference.

BACKGROUND

The present invention is an improvement on the Gifford-McManon cycle. Familiarity with said cycle is assumed. Representative prior art patents teaching such cycle include U.S. Pats. Nos. 2,966,035; 3,188,818; 3,218,815; and 4,305,741.

For maximum efficiency and reliability, it is important to have maximum gas volume transfer through the regenerator. In order that this may be attained, it is important that the direction of gas flow be reversed when the displacer is at top dead center or bottom dead center. The present invention is directed to a solution of that problem by utilizing an electric motor to precisely control a slidable valve for controlling fluid flow when the displacer is adjacent top dead center and bottom dead center.

SUMMARY OF THE INVENTION

The present invention is directed to a cryogenic refrigerator in which a movable displacer defines within an enclosure first and second chambers of variable volume. A refrigerant fluid is circulated in a fluid flow path between the first chamber and the second chamber and correlated with movement of the displacer.

The refrigerator includes chamber means for guiding a slide connected to the displacer. A motor is connected to the slide for controlling movement of the displacer. A valve is provided with a valve member for controlling flow of the high and low pressure fluid. The valve member is reciprocated by a cam driven by said electric motor.

It is an object of the present invention to provide a cryogenic refrigerator wherein efficiency and reliability are improved by controlling reciprocatory movement of the displacer and valve member in a positive synchronized manner by an electrical motor.

It is an object of the present invention to provide a cryogenic refrigerator wherein a reciprocatory valve for controlling introduction of high and low pressure fluid is moved in a positive manner so as to be less sensitive to friction and contamination.

It is another object of the present invention to provide a refrigerator that may be converted to a heat pump in an inexpensive facile manner.

Other objects will appear hereinafter.

For the purpose of illustrating the invention, there is provided in the drawings a form which is presently preferred; it being understood, however, that this invention is not limited to the precise arrangements and instrumentalities shown.

DETAILED DESCRIPTION

Figure 1:
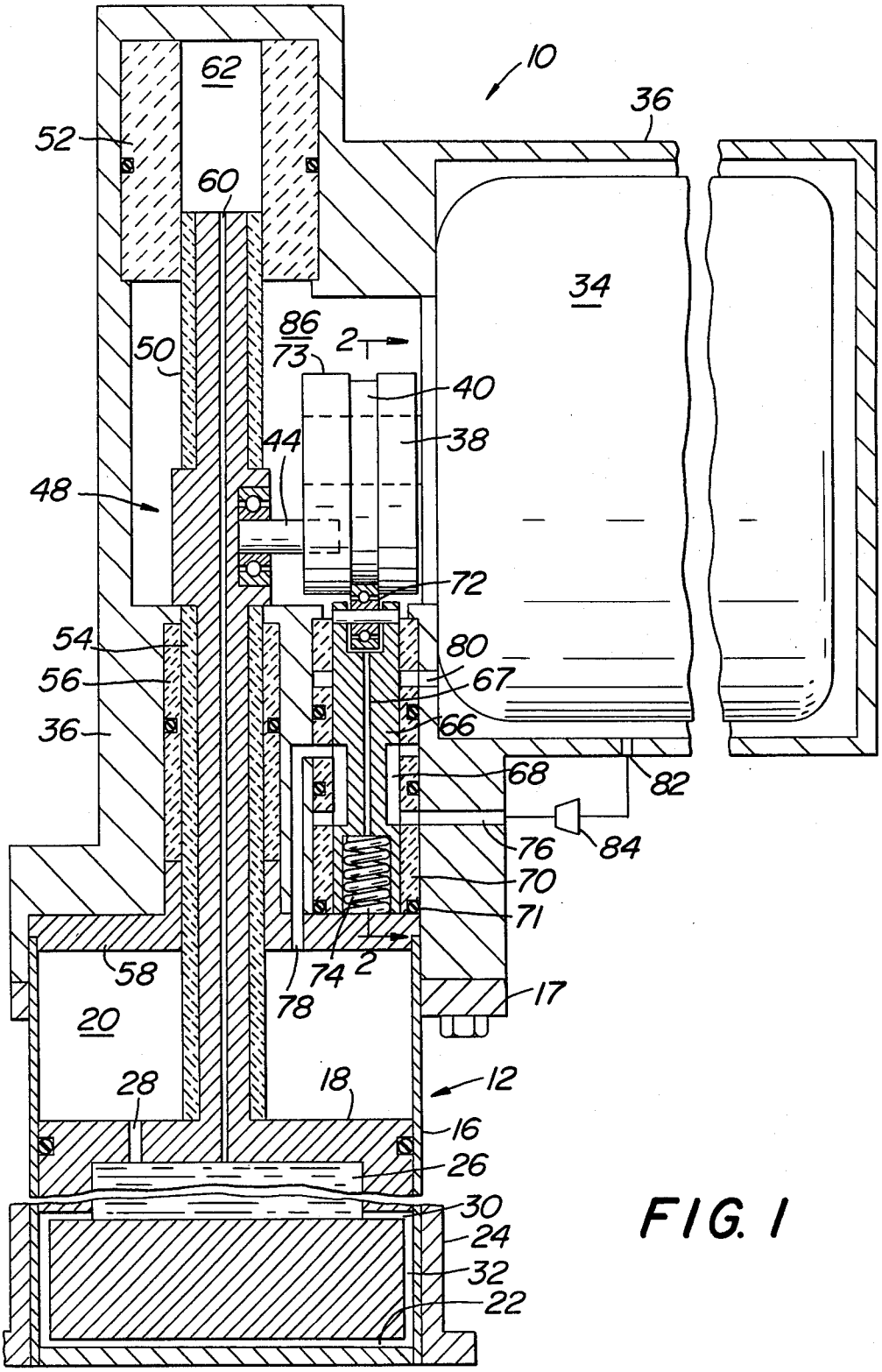
FIG. 1 is a vertical sectional view of a refrigerator in accordance with the present invention with the displacer at bottom dead center.

Referring to the drawings in detail, wherein like numerals indicate like elements, there is shown a refrigerator in accordance with the present invention designated generally as 10. As illustrated, the refrigerator 10 has a first stage 12. It is within the scope of the present invention to have one or more stages. When in use, the stages are disposed within a vacuum housing not shown. Each stages includes a housing 16 within which is provided a displacer 18. The displacer 18 has a length less than the length of the housing 16 so as to define a warm chamber 20 thereabove and a cold chamber 22 therebelow. The designations warm and cold are relative as is well known to those skilled in the art.

Within the displacer 18, there is provided a regenerator 26 containing a matrix. Ports 28 communicate the upper end of the matrix in regenerator 26 with the warm chamber 20. Radially disposed ports 30 communicate the lower end of the matrix in regenerator 26 with a clearance space 32 disposed between the outer periphery of the lower end of the displacer 18 and the inner periphery of the housing 16. Thus, the lower end of the matrix in regenerator 26 communicates with cold chamber 22 by way of ports 30 and clearance 32 which is an annular gap heat exchanger.

The matrix in regenerator 26 is preferably a stack of 250 mesh material having high specific heat such as oxygen-free copper. The matrix has low void area and low pressure drop. The matrix may be other materials such as lead spheres, nylon, glass, etc.

An electrical motor 34, such as a reversible synchronous stepper motor, is disposed within a housing 36. Housing 16 depends downwardly from and has a flange 17 bolted to housing 36. The output shaft 46 of motor 34 is connected to a cam 38. Cam 38 has a peripheral groove 40. A roller bearing type follower 42 is connected to cam 38 by shaft 44. Shafts 44 and 46 are parallel. Follower 42 is disposed within a transverse slot on slide 48. Slide 48 is connected to the upper end of the displacer 18.

The slide 48 has a cylindrical bearing insert 50 guided by clearance seal sleeve bearing 52. The slide 48 also has a cylindrical bearing insert 54 guided by clearance seal sleeve bearing 56. The bearing inserts and sleeve bearings are preferably made from a ceramic material or other hard material such as silicon carbide. The sleeve bearing 56 is held in place by a retainer 58 connected to the housing 36. A chamber 62 within sleeve bearing 52 communicates with the regenerator 26 by way of an axial flow passage 60 in the slide 48. Passage 60 prevent air from being compressed within chamber 62 as the slide 48 moves. Hence, slide 48 is gas balanced when its diameter is uniform at its ends.

The housing 36 includes a bore parallel to the slide 48. Within the bore there is provided a clearance seal sleeve bearing 70 preferably made from a ceramic material. Within the sleeve bearing 70, there is provided a spool valve designated generally as 64. The valve 64 includes a cylindrical spool valve member 66 having a groove 68 on its outer periphery between its ends. Member 66 has an axially extending equalizing passage 67. A seal 71 is provided between the bearing 70 and the retainer 58. O-ring seals are preferably provided on elements 18, 52, 56, and 70 as shown in FIG. 1.

A roller bearing 72 having inner and outer races maybe rotatably supported by the upper end of the valve member 66. Bearing 72 rotates about an axis which is parallel to the axis of shafts 38, 44. Bearing 72 is received within the groove 40 whereby the valve member 66 cannot rotate abouts it longitudinal axis. Bearing 72 is optional and may be replaced by a cam follower.

A coil spring 74 extends between retainer 58 and a recess in valve member 66 for biasing the roller bearing 72 into the groove 40 on cam 38. The valve member 66 is moved downwardly by the cam 38 and is moved upwardly by expansion of the spring 74. Bearing 72 is the only portion of the valve member in contact with cam 38.

Figure 2:
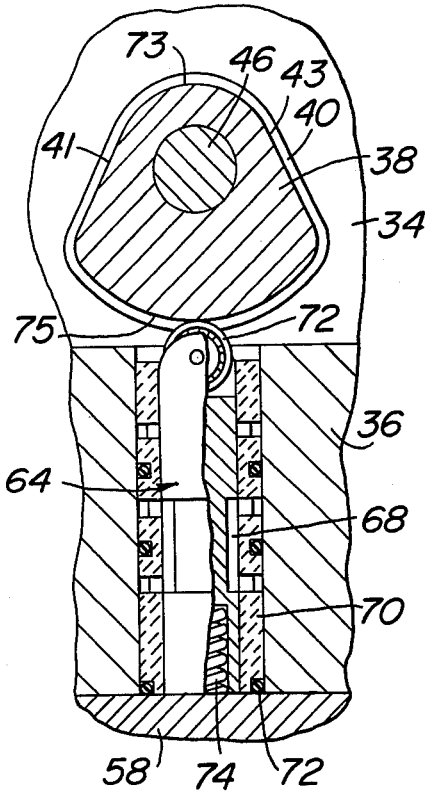
FIG. 2 is a sectional view taken along the line 2—2 in FIG. 1.
Figure 3:
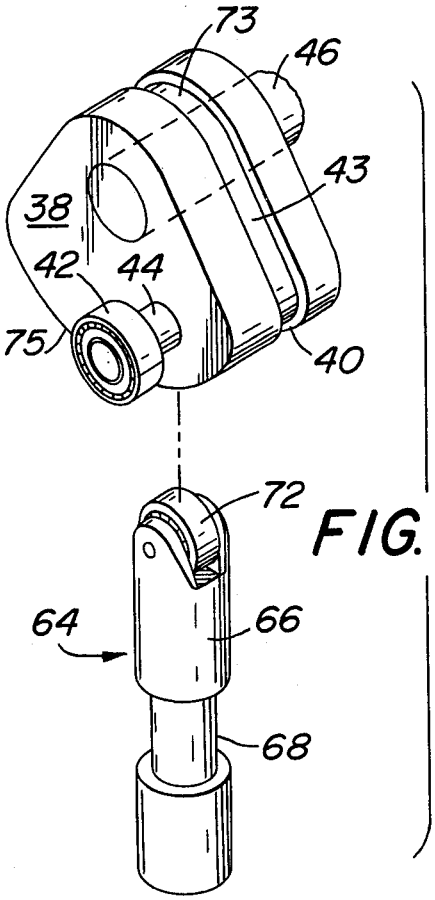
FIG. 3 is an exploded view of the valve member and cam.

The contour of groove 40 corresponds to the contour of the outer periphery of cam 38 as shown more clearly in FIG. 2. Thus, the contour of groove 40 includes a pair of converging straight portions 41, 43 interconnecting arcuate surfaces 73, 75. Each of surfaces 73 and 75 have a center of curvature coinciding with the longitudinal axis of shaft 46. The radius of surface 75 and its dwell time is approximately 1.75 to 2 times the radius of surface 73 and its dwell time. Bearing 42 is adjacent surface 75 as shown in FIG. 3.

Referring to FIG. 1, high pressure is introduced into port 76 from the outlet side of a compressor 84. Port 76 communicates with the groove 68 when the valve member 66 is in the position as shown in FIG. 1. When valve member 66 is in the position as shown in FIG. 1, groove 68 also communicates with warm chamber 20 by way of passage 78.

A passage 80 extends from the interior of housing 36 and is blocked by the valve member 66 in the position of the latter shown in FIG. 1. When the roller bearing 72 is in contact with surface 73 on cam 38, the groove 68 communicates passage 78 with passage 80. The interior of the housing 36 communicates with the inlet side of compressor 84 by way of port 82. Chamber 86 is in direct communication with the interior of housing 36. The flow of a refrigerant from passage 80 to port 82 has a cooling effect on the motor 34. If desired, passage 80 may be eliminated by causing groove 68 to communicate with chamber 86 at the top dead center position of valve member 66. It will be noted that the axial length of groove 68 is less than the axial distance between ports 76 and 80 to thereby minimize leakage of high pressure gas between said ports and passage 78.

The housing 36 is constructed of a number of components so as to facilitate machining, assembly, access to the valve member 66 and slide 48. The manner in which the housing 36 is comprised of a plurality of components is not illustrated but will be obvious to those skilled in the art.

The refrigerator 10 is preferably designed for use with a cryogenic fluid such as helium but other fluids such as air and nitrogen may be used. The refrigerator 10 was designed to have a wattage output of at least 65 watts as 77° K. and a minimum of 5 watts at 20° K.

Figure 4:
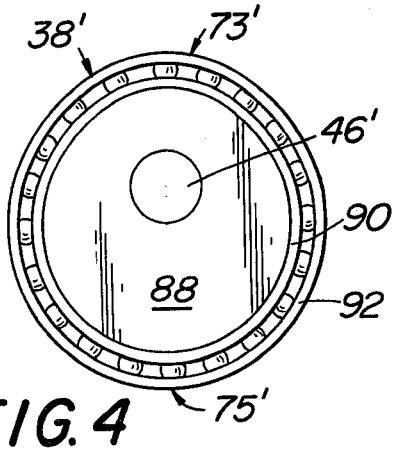
FIG. 4 is a plan view of an alternate cam.

In FIG. 4, there is illustrated a plan view of cam 38'. Cam 38' is the same as cam 38 except as follows. The transition between surfaces 73', 75' is more gradual thereby eliminating the straight portions 41, 43 and the dwell. Therefore, cam 38' causes the valve member to be in constant motion except at top and bottom dead center. Cam 38' slows down the opening and closing movement of valve member 66 to thereby maximize the heat transfer between the fluid and the matrix of regenerator 26. Cam 38' is preferably defined by eccentric disk 88 connected to the inner race 90 of a dual race bearing. The outer race 92 would contact and move the valve member in the manner described herein.

On a large unit, it is often desirable to add gas pressure to assist in movement of the displacer. Thus, if passage 80 communicates directly with the inlet of compressor 84, gas at an intermediate pressure may be introduced into chamber 86. Also, the slide 48 would have a differential pressure reaction surface which could be attained by changing the diameter of the upper end of the slide.

OPERATION

As shown in FIG. 1, the displacer 18 is at bottom dead center. Vertical reciprocation of slide 48 is controlled by the rotative position of cam 38 and the cooperation between follower 42 and the slide groove receiving the follower. The spool valve member is in its lowermost position with the spring 74 compressed due to contact between the roller bearing 72 and surface 75 on the cam 38. High pressure fluid is introduced from port 76, through groove 68, and passage 78 to the warm chamber 20. Passage 80 is blocked by the valve member 66.

The function of the regenerator 26 is to cool the gas passing downwardly therethrough and to heat gas passing upwardly therethrough. In passage downwardly through the regenerator, the gas is cooled thereby causing the pressure to decrease and further gas to enter the system to maintain the maximum cycle pressure. The decrease in temperature of the gas in chamber 22 is useful refrigeration which is sought to be attained by the apparatus at heat station 24. As the gas flows upwardly through the regenerator 26, it is heated by the matrix to near ambient temperature thereby cooling the matrix. As the motor 34 rotates cam 38 counterclockwise in FIG. 2, and the displacer 18 is moved upwardly from bottom dead center, the cam surface 75 controls the intake portion of the cycle. As the cam 38 continues to rotate, the straight portion 41 of the groove 40 enables the valve member 66 to move upwardly under the pressure of spring 74. Valve member 66 closes off flow from port 76.

As the cam 38 continues to rotate, the slide 48 and displacer 18 continue to move upwardly. As the slide 48 approaches top dead center, cam surface 73 permits the valve member 66 to be reciprocated sufficiently upwardly so as to cause groove 68 to communicate passages 78 and 80 and thereby commence the exhaust portion of the cycle. Timing of the exhaust portion of the cycle is controlled by the length of surface 73. As the cam 38 continues to rotate, straight portion 43 on cam 38 moves the valve member 66 downwardly until the roller bearing 72 is in contact with surface 75 which defines the time period for the introduction of high pressure gas from port 76. One complete cycle is now completed.

A typical embodiment operates at the rate of 72 to 80 cycles per minute. The reciprocatory movement of the displacer 18 and valve member 66 is synchronized to occur simultaneously in the same direction with the stroke of displacer 18 being greater than the stroke of valve member 66. Timing is predetermined by cam 38 so that valve member 66 and displacer 18 reciprocate at different rates. The length of stroke of the valve member 66 is short such as 9 to 12mm and 30mm for the displacer 18. Valve member 66 may be provided with an axial flow passage 67 communicating the low pressure of chamber 86 to the chamber containing spring 74.

One problem with prior art devices is that the diameter of the slide bearing is only about 0.25 inches ID. The slide 48 is gas-balanced. This enables the ID of the clearance seal bearings 52, 56 to be 0.75 inches ID or 9 times as large with respect to surface area and hence only be subjected 1/9 the unit forces. Accordingly, the bearings will not wear out rapidly as is the case with the prior art devices.

The refrigeration available at heat station 24 may be used in connection with a wide variety of devices. One such device is a cryopump. The structural interrelationship disclosed results in positive control over the simultaneous movements of the slide 48 and valve member 66 so that introduction of high pressure gas and exhausting of low pressure gas is synchronized in a positive manner. Because high and low pressure gas is introduced or exhausted at the exact position of bottom dead center and top dead center for the slide 48, efficiency is increased with assurance of a complete introduction or exhaustion of a charge of gas.

When a cryopump becomes saturated whereby it no longer absorbs nobel gases, it heats up and puts a load on heat station 24. When the temperature of heat reaches about 20° K., a signal is initiated such as by a diode on the cryopump. It is thereafter necessary to apply heat to the cryopump. This can be accomplished by converting refrigerator 10 to a heating mode.

In order to cause refrigerator 10 to operate in a heating mode, it is only necessary to reverse the direction of rotation of motor 34. Cam 38 now rotates clockwise in FIG. 2. Valve member 66 is operated about 70° out of phase with its operation during a refrigeration mode. It is unexpected that a cryogenic refrigerator may become a heat pump merely by reversing the direction of rotation of a drive motor so that a cryopump can be regenerated in 35 minutes as compared to conventional regeneration in 3½ hours. A conventional diode on the cryopump may be used to trigger reversal of motor 34 at the beginning and end of the heating mode. Reversing the direction of motor 34 has no effect on its ability to reciprocate slide 48 and displacer 18 but does change the area of the PV diagram which is about 20% smaller.

The present invention may be embodied in other specific forms without departing from the spirit of essential attributes thereof and, accordingly, reference should be made to the appended claims, rather than to the foregoing specification, as indicating the scope of the invention.

I claim:

1. In an cryogenic refrigerator in which a moveable displacer means defines within an enclosure first and second chambers of variable volume, and in which a refrigerant fluid is circulated in a fluid path between the first chamber and the second chamber by movement of the displacer means, the improvement comprising chamber means for guiding a slide connected to the displacer means, a moter connected to said slide for reciprocating said slide, a valve having a reciprocal valve member for controlling the flow of high and low pressure fluid, said valve member having a peripheral groove which is of uniform depth at its ends, said moter being connected to a cam arranged to reciprocate said valve member in timed relation with reciprocation of said slide so that the valve member will introduce high pressure fluid via said groove into said first and second chambers when the displacer means is at one of the extremities of its movement.

2. Apparatus in accordance with claim 1 including a roller bearing rotatably connected to one end of said valve member, said roller bearing being in contact with said cam, and spring means biasing said valve member toward said cam.

3. Apparatus in accordance with claim 2 wherein said cam has two oppositely disposed arcuate surfaces each having a center of curvature coinciding with the axis of rotation of said cam, and said surfaces being at different distances from said axis.

4. Apparatus in accordance with claim 1 wherein said cam is between said motor and said slide, a follower on said cam cooperating with a transverse groove in said slide to reciprocate said slide.

5. Apparatus in accordance with claim 1 wherein said cam has a groove on its outer periphery for guiding and moving said valve member.

6. Apparatus in accordance with claim 1 including said displacer means having a regenerator therein, said slide being gas-balanced and having an axial flow passage communicating at one end with said regenerator, and ceramic clearance seal sleeve bearings for said slide, said bearings having an ID of at least 0.5 inches.

7. In a cryogenic refrigerator in which a movable displacer means defines within an enclosure first and second chambers of variable volume, and in which a refrigerant is circulated in a fluid flow path between said first chamber and said second chamber in a manner correlated with movement of the displacer means, a slide connected to the displacer means, a valve for controlling flow of said fluid in said flow path, an electrical motor having its output shaft mechanically connected to said valve for controlling movement of said valve and being mechanically connected to said slide for controlling movement of said slide in timed relation with movement of said valve.

8. Apparatus in accordance with claim 7 wherein said motor output includes a cam for controlling movement of said valve, and said motor output being coupled to said slide by way of a follower attached to the cam at a location on the cam which causes the valve to permit high pressure gas to enter said first and second chambers.

9. Apparatus in accordance with claim 7 wherein said valve includes a slidable valve member spring biased into contact with said cam.

10. Apparatus in accordance with any one of claims 1–9 including means for causing the refrigerator to operate in a heating mode, said last-mentioned means including said motor being an electrical reversible motor for causing said valve to be operated 180° out of phase as compared when it is a refrigeration mode.

11. Apparatus in accordance with claim 7 wherein said slide is of uniform cross-section at its ends and is gas balanced.

* * * * *